US005574766A

United States Patent [19]

Panasik

[11] Patent Number: 5,574,766

[45] Date of Patent: Nov. 12, 1996

[54] X-RAY BEAM LIMITER

[75] Inventor: Cheryl L. Panasik, Bartlett, Ill.

[73] Assignee: Picker International, Inc., Cleveland, Ohio

[21] Appl. No.: 547,301

[22] Filed: Oct. 24, 1995

[51] Int. Cl.[6] ..... G21K 1/02

[52] U.S. Cl. ..... 378/147; 378/150; 378/160

[58] Field of Search ..... 378/145, 147, 378/148, 150, 151, 152, 153, 159, 160, 161, 204, 210; 250/505.1

[56] References Cited

U.S. PATENT DOCUMENTS 4,897,861 1/1990 Schaefer et al. ..... 378/150

4,905,268 2/1990 Mattson et al. ..... 378/158

*Primary Examiner*—David P. Porta
*Assistant Examiner*—Don Wong
*Attorney, Agent, or Firm*—Timothy B. Gurin; John J. Fry

[57] ABSTRACT

An x-ray beam limiter includes a compressible disc 18 containing an aperture 20 and a slot 22 extending from the aperture to the outer edge 28 of the disc. The outer edge 28 of the disc 18 is covered with a bearing material and is retained within a groove 36 in a bearing retaining race 32 such that the disc 18 is rotatable within the retaining race 32. A beam limiter 54 is mounted to the disc 18. The disc 18 and beam limiter 54 are rotatable between at least two different positions.

20 Claims, 3 Drawing Sheets

X-RAY BEAM LIMITER

FIELD OF THE INVENTION

The invention relates to x-ray beam limiters. It finds particular application in conjunction with x-ray sources for computed tomographic ("CT") scanners and will be described with particular reference thereto. It will be appreciated, however, that the invention may find further application in other areas where resistance to contamination, ease of manufacture, and physical size constraints are important in the design or selection of a bearing for such devices.

DESCRIPTION OF THE RELATED ART

In certain x-ray equipment, including x-ray equipment used in computed tomography applications, it is desirable to change the fan angle of the x-ray beam traversing a scan area. An apparatus and method for performing this function is described in U.S. Pat. No. 4,905,268 entitled *Adjustable Off-Focal Aperture for X-Ray Tubes* to Mattson, et al., incorporated by reference herein.

As more fully described in Mattson, a beam limiting plate is rotatably mounted within the path of the x-ray beam such that the position of the plate and the corresponding fan beam width may be changed by rotating the plate. With particular reference to FIG. 3 of Mattson, the rotatable mounting was accomplished using ball bearings.

Although ball bearing beam limiting devices have functioned acceptably, aspects of these devices may be improved. Particulate matter may become deposited between the ball bearings, causing the balls to become jammed, thus causing the device to stick. The device must be serviced to alleviate this condition.

Various attempts have been made to alleviate the effects of such particulate contamination. One approach was to remove one of the ball bearings from the assembly to increase clearance, but this is at best a temporary solution. More recently, various bearing platings were used in order to eliminate the use of dry bearing lubricant. This approach ultimately did not prevent the accumulation of particles between the balls. Yet another approach was to reduce the entry of contaminants by surrounding the assembly with a physical barrier. This approach proved unsatisfactory, however, primarily because particulates from sources internal to the assembly can still contribute to contamination.

Another disadvantage associated with the use of prior art bearings is the extensive labor required in the manufacturing process. In the prior art, approximately sixty balls were used within each bearing. Accordingly, the use of bearings other than ball bearings would simplify the manufacturing process.

One alternative approach which eliminates the need for ball bearings is the use of conventional sleeve or cylinder bearings. Conventional techniques, however, require the use of one or more snap rings to hold the bearing in place. The snap rings require additional physical space within the bearing assembly and may also require additional machining to create grooves for the snap rings.

For the foregoing reasons, there is a need for an x-ray beam limiting device which is exhibits increased reliability, is simpler to manufacture, and which requires a minimum of physical space and componentry.

SUMMARY

According to one aspect of the present invention, a sleeve bearing for use with an x-ray beam limiting device is provided. The sleeve bearing includes a disc characterized by a diameter and a radiused outer edge, the outer edge having a bearing surface. The bearing further comprises means for permitting the diameter of the disc to be reduced to a compressed diameter when a compressive force is applied to the disc and for urging the disc to return to substantially its original diameter when the compressive force is removed. The sleeve bearing also includes a bearing retaining race which has an inner diameter smaller than the uncompressed diameter of the disc. There is a circular groove within the inner diameter of the race. The groove has a diameter and radius sized to accept the disc and permit the disc to rotate. Thus, the disc can be inserted in the groove when a compressive force is applied to the disc. The disc is rotatably retained within the groove when the compressive force is removed. It will be appreciated that the foregoing eliminates the need for ball bearings as well as retaining rings associated with conventional sleeve bearings. It will further be appreciated that the invention obviates the need for bearing lubrication, reduces susceptibility to particulate contamination, and simplifies assembly.

According to another aspect of the invention, the bearing surface comprises polytetrafluoroethylene, and the bearing race is stainless steel. In yet other aspects of the present invention the disc is made from a resin containing fiberglass or from a polyetherimide resin.

In yet another aspect of the invention, the beam limiter further includes an actuator means for causing a predetermined angular rotation of the disc, spring means for urging the disc to return to a predetermined position, and an x-ray beam limiter mounted to the disc.

In another aspect of the invention, the means which permit the diameter of the disc to vary when a compressive force is removed is an aperture within the disc and a slot extending from the aperture to the outer edge of the disc.

According to another aspect of the present invention, the sleeve bearing retaining race has an inner diameter with a circular groove characterized by a diameter and a radius disposed therein. The sleeve bearing further includes a disc having a radiused outer edge, an aperture, and a slot extending between the aperture and the outer edge. The outer edge of the disc has a bearing surface, and the disc with the bearing surface applied to it has an uncompressed diameter which is less than or equal to the diameter of the groove and which is retained within the groove. The disc is thereby rotatably mounted within the retaining race when the compressive force is removed.

In another aspect of the invention, the beam limiter comprises a bearing retaining race having an inner diameter and a groove disposed within the inner diameter. A rotating assembly includes a disc having a bearing surface applied to its outer diameter and which is retained within the groove so that the disc is rotatable about an axis orthogonal to the plane of the disc. A radiation attenuating means having at least first and second differently dimensioned radiation passing positions which cross at the axis of rotation is mounted to the disc. The disc further contains means for rotating the disc between at least first and second positions.

DRAWINGS

The invention may take form in various steps or arrangement of steps or in various components and arrangements of components. The drawings are only for purposes of illustrating a preferred embodiment and are not to be construed as limiting the invention.

DESCRIPTION

Figure 2:
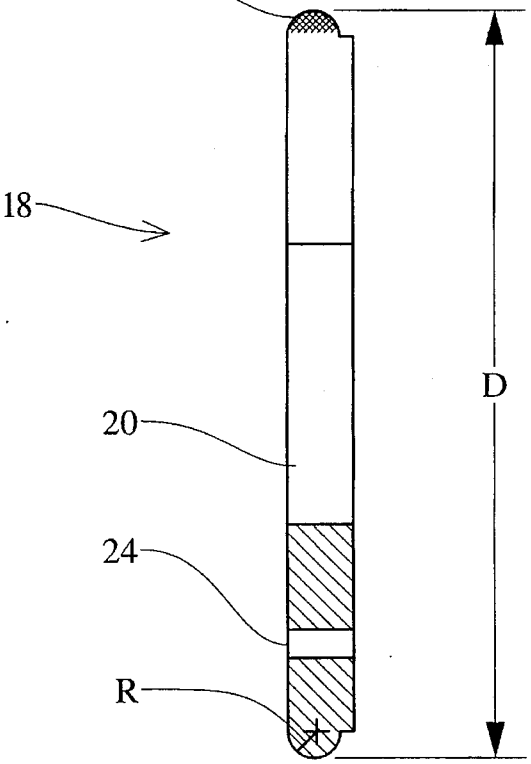
FIG. 2 is a sectional view through section 2—2 of FIG. 1.
Figure 1:
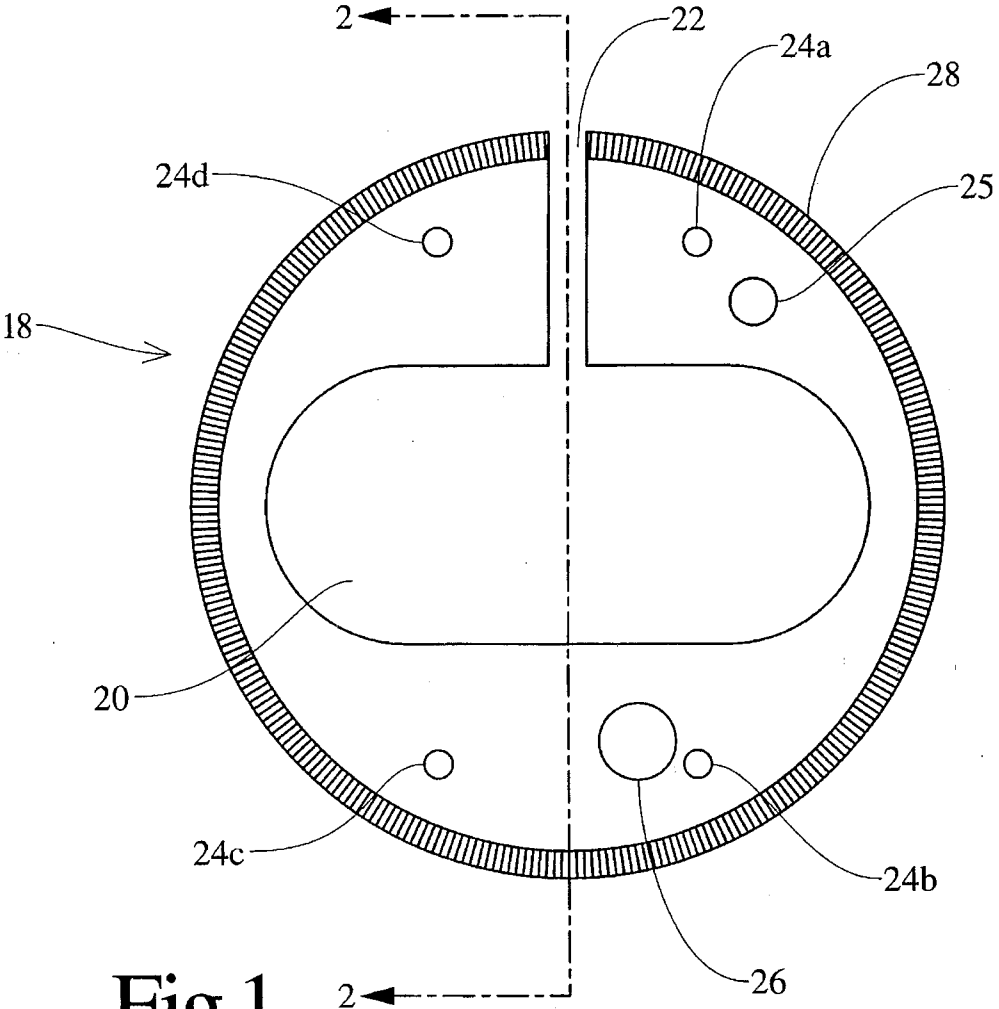
FIG. 1 is a front elevation view of a bearing disc according to the present invention.

FIG. 1 shows a disc 18 which contains an aperture 20 and a slot 22 extending from the aperture 20 to the outer edge 28 of the disc 18. Mounting means such as screw holes 24*a–d* permit a beam limiting plate to be rigidly fastened to the disc 18 using fasteners such as screws. Mounting means such as a screw hole 26 provides a rigid mounting for an actuator pin. Mounting means such as screw hole 25 permits mounting of a return spring. In an uncompressed state, the disc 18 has a diameter D. The outer edge of the disc 18 has a radius R as shown in FIG. 2.

The disc 18 is manufactured from a material which is not degraded by exposure to radiation such as a filament wound fiberglass epoxy resin matrix. An alternative material for the disc 18 is a polyetherimide resin with thirty percent (30%) glass reinforcement such as that sold as a shaped material under the trademark "Ultem®" by Westlake Plastic Company of Lennl, PA. The radiused portion of the outer edge 28 of disc 18 is covered with a bearing material such as a woven fabric containing polytetrafluoroethylene fibers ("TFE," sold under the trademark "Teflon®") interwoven with bondable polyester (sold under the trademark "Dacron®") yarns. Suitable fiberglass disc material with fabric applied thereto is sold under the trademark Duralon® by Rexnord Corporation in Downers Grove, IL.

The aperture 20 and the slot 22 in the disc 18 permit the diameter D of the disc 18 to be reduced to a compressed diameter D* when a compressive force is applied to the disc 18, such as by using conventional snap ring pliers inserted into the holes 24*a* and 24*d*.

Figure 4:
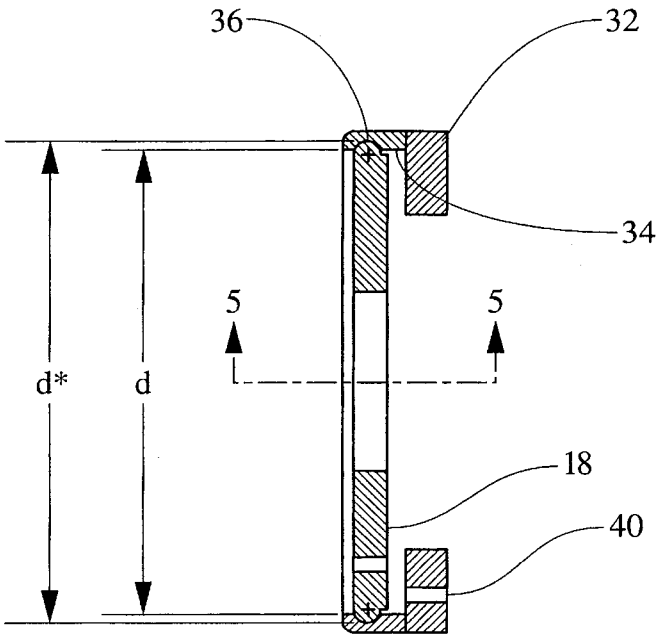
FIG. 4 is a sectional view through section 4—4 of FIG. 3.
Figure 3:
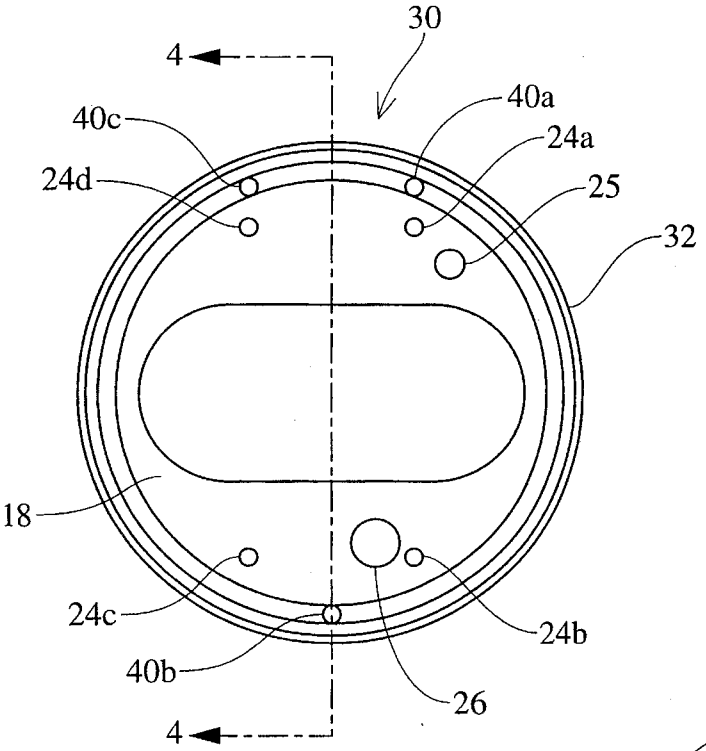
FIG. 3 is a front elevation view of a sleeve bearing assembly.
Figure 5:
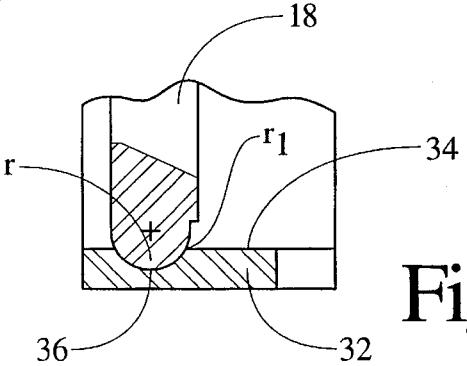
FIG. 5 is a sectional view through section 5—5 of FIG. 4.

FIG. 3 shows a sleeve bearing assembly 30, which comprises the disc 18 and a bearing retaining race 32. With reference to FIG. 4, the bearing retaining race 32 is characterized by a cylindrical inner surface 34 having a diameter d. A groove 36 having a maximum diameter d* and radius $r_1$ is disposed within the inner surface 34. Fastening means such as a screw holes 40*a–c* are disposed within one surface of retaining race 32. The retaining race, most particularly the area forming the groove 36, is preferably constructed from stainless steel. FIG. 5 shows a detail of the disc 18 inserted within the retaining race 32. The radius $r_1$ and diameter d* of the groove 36 are machined to match the radius r and uncompressed diameter D (said diameter D including the thickness of the bearing material) of the disc 18. Satisfactory operation has been obtained wherein the uncompressed diameter D is slightly smaller than the groove 36 diameter d*, thereby providing a clearance in the range of 0.004 to 0.008 inches. Satisfactory operation has been obtained where the radius r of the disc 18 is smaller than the radius $r_1$ of the groove 36, specifically with a radius r of 0.063 inches and a radius $r_1$ up to 0.090 inches.

Figure 6:
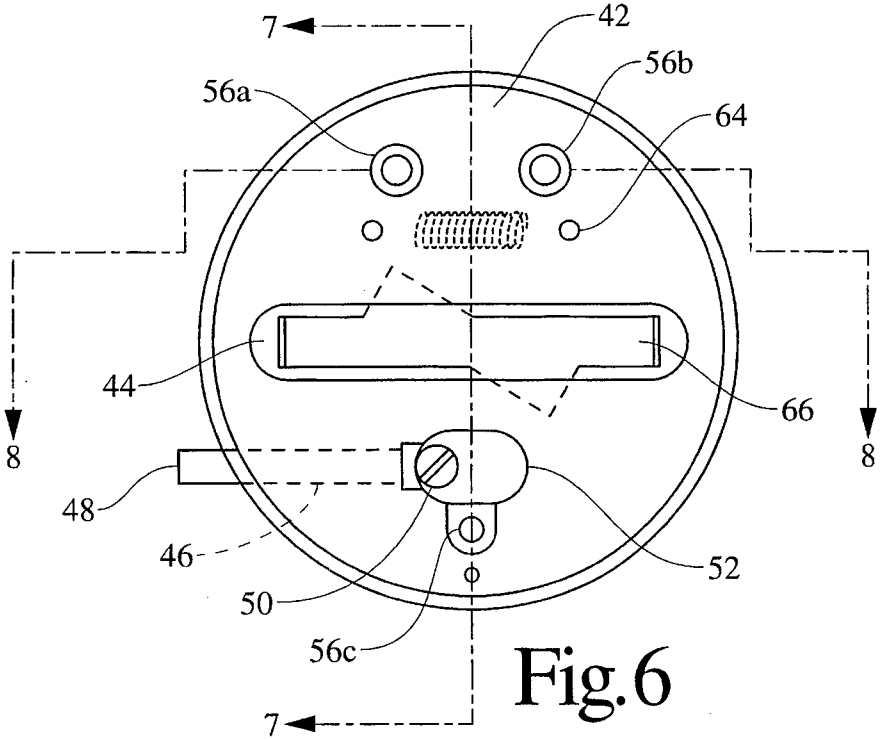
FIG. 6 is a front elevation view of a beam limiter assembly.

With reference to FIG. 6, a support plate 42 comprises an elongated aperture 44 and a bore 46. The elongated aperture 44 defines an area through which x-rays can pass unobstructed though the support plate 42. The bore permits entry of an actuator 48. The support plate further contains fastening means such as countersunk screw holes 56*a–c* which permit the support plate 42 to be fastened to the sleeve bearing assembly 30. Actuator 48 is disposed against the actuator pin 50. The face of the support plate 42 is constructed of a dense, x-ray absorbing material or materials such as one or more layers of lead supported on a structurally stronger material which may also have high energy absorbing properties. An aperture 52 within the support plate 42 permits entry of an actuator pin 50. The outer edges of the aperture 52 define a range of motion for the actuator pin.

Figure 7:
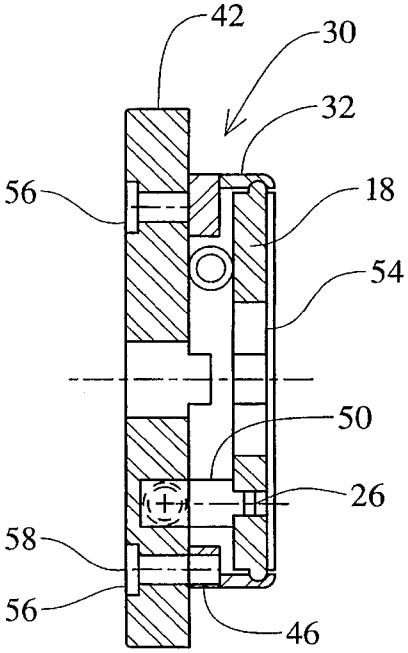
FIG. 7 is a sectional view through section 7—7 of FIG. 6.

With reference to FIG. 7, the support plate 42 is fastened to the sleeve bearing assembly 30 using conventional button head screws 58 inserted through apertures 56*a–c* and in communication with screw holes 40*a–c* in bearing assembly 30. The actuator pin 50 is screwed into the screw hole 26 in the disc 18 and is partially disposed within the aperture 52 in the support plate 42. A beam limiter 54 is fastened to bearing disc 18 using conventional flathead screws disposed through the beam limiter 54 and in communication with screw holes 24*a–d* in disc 18. The beam limiter is constructed of a dense, x-ray absorbing material, such as tungsten, tantalum, or reinforced lead alloys. With reference to FIG. 6 and also to U.S. Pat. No. 4,905,268, the beam limiter 54 contains an aperture 66 which defines a first or whole body scan radiation passing portion and a second or head scan radiation passing portion.

Figure 8:
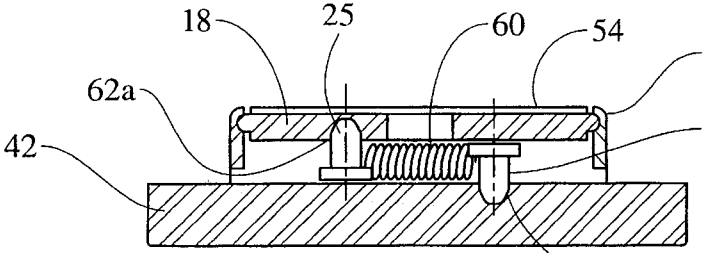
FIG. 8 is a sectional view through section 9—9 of FIG. 7.

Turning now to FIG. 8, a return means such as a return spring 60 is operatively disposed between the support plate 42 and disc 18 using fastening means such as screws 62*a–b* protruding through fastening points in each end of the spring 60 and in communication with the screw holes 25 and 64 disposed within the disc 18 and the support plate 42, respectively.

To assemble, the actuator pin 50 is screwed into the disc 18. The spring 60 is attached to the disc 18, which disc 18 is then compressed to a reduced diameter, inserted within the groove 36 of the retaining race 32, and the compressive force is removed. The beam limiter 54 is then screwed into the face of the disc 18, and the actuator 48 is inserted into the bore 46 in the support plate 42. The support plate 42 is fastened to the retaining race 32. When used within a conventional CT system, the assembly is placed inside a lead shield to prevent x-ray leakage.

In operation, the actuator 48 is depressed. The actuator 48 presses against the actuator pin 50, causing the bearing disc 18 and consequently the beam limiter 54 to rotate together as a rotating assembly within the bearing retaining race 32. The rotational motion is limited by the retaining pin 50 contacting the edge of aperture 52 which limits rotation to a position in which the head scan radiation passing portion of the beam limiter 54 is aligned with the elongated aperture 44 in the support plate 42. The rotational motion causes the spring 60 to become extended and thereby exert a force urging rotation of the disc 18 and consequently the beam limiter 54 to return their original positions, such rotation being prevented by the actuator 48. When the actuator 48 is retracted, rotational motion is again limited by the retaining pin 50 contacting the other side of the aperture 52 which limits rotation to a position in which the whole body scan portion of the beam limiter 54 is aligned with the elongated aperture 44 in the support plate 42.

Thus, it can be seen that the instant invention provides a reliable, more easily assembled, and more compact x-ray beam limiter than was previously known. It will be appreciated that the invention has been described with reference to its preferred embodiments. Obviously, modifications and alterations will occur to others upon reading and understanding the preceding detailed description. It is intended that the invention be construed as including all such alterations and modifications insofar as they come within the scope of the appended claims or the equivalents thereof.

What is claimed is:

1. An x-ray beam limiter assembly, comprising:

a bearing retaining race having an inner surface characterized by an inner diameter, the inner surface having a groove with a diameter and radius disposed therein; and a rotating assembly rotatably mounted with respect to the bearing retaining race, the rotating assembly comprising a disc having a diameter and a radiused outer edge;

a bearing surface on the outer edge;

means for permitting the diameter of the disc to be reduced to a compressed diameter when a compressive force is applied to the disc and for urging the disc to return to substantially its original diameter when the compressive force is removed, whereby the disc can be inserted within the groove when a compressive force is applied to the disc and the disc is rotatably retained within the groove when the compressive force is removed; and a radiation attenuating member fastened to the disc and having at least first and second differently dimensioned radiation passing positions which cross at the axis of rotation of the rotating assembly; and means for rotating the rotating assembly between first and second positions, whereby the rotation attenuating member is rotatable between a first and a second position.

2. The x-ray beam limiter of claim 1 wherein the means for rotating comprises:

a support plate;

an actuator pin fastened to the disc and disposed within an aperture in the support plate, the aperture and pin defining first and second rotatable positions of the disc;

an actuator disposed with a bore contained with the support plate and in communication with the actuator pin, which actuator causes the disc to assume the first rotatable position when the actuator is depressed; and a spring fastened to the disc and to the support plate which causes the disc to assume the second position when the actuator is not depressed.

3. A sleeve bearing beam limiter comprising:

a disc having a diameter and a radiused outer edge, the outer edge having a bearing surface applied thereto;

means for permitting the diameter of the disc to be reduced to a compressed diameter when a compressive force is applied to the disc and for urging the disc to return to substantially its original diameter when the compressive force is removed; and a bearing retaining race having an inner surface characterized by a diameter smaller than the uncompressed diameter of the disc and a groove disposed within the inner surface, the groove having a diameter and a radius which accept the disc and permit rotation thereof;

whereby the disc can be inserted in the groove when a compressive force is applied to the disc and the disc is rotatably retained within the groove when the compressive force is released.

4. The beam limiter of claim 3 wherein the bearing surface comprises polytetrafluoroethylene.

5. The beam limiter of claim 4 wherein the disc comprises a fiberglass epoxy resin.

6. The beam limiter of claim 4 wherein the disc comprises a polyetherimide resin.

7. The beam limiter of claim 3 wherein the means for permitting and urging is an aperture within the disc and a slot extending from the aperture to the outer edge of the disc.

8. The beam limiter of claim 3 further comprising:

an actuator means for causing a predetermined angular rotation of the disc;

spring means for urging the disc to return to a predetermined position; and an x-ray beam limiter mounted to the disc.

9. A sleeve bearing beam limiter comprising:

a bearing retaining race having an inner surface characterized by an inner diameter, the inner surface having a groove with a diameter and radius disposed therein; and a disc having a radiused outer edge, an aperture, and a slot extending between the aperture and the outer edge, and a bearing surface disposed on the outer edge, the disc with the bearing surface applied thereto having an uncompressed diameter, the uncompressed diameter being less than or equal to the diameter of the groove and which bearing surface is retained within the groove; whereby the disc can be inserted into the groove when a compressive force is applied thereto and which is rotatably mounted within the retaining race when the compressive force is removed.

10. The beam limiter of claim 9 wherein the beating surface comprises polytetrafluoroethylene.

11. The beam limiter of claim 9 wherein the disc comprises a fiberglass resin.

12. The beam limiter of claim 9 wherein the disc comprises a polyetherimide resin.

13. An x-ray beam limiter comprising:

a bearing retaining race having an inner surface characterized by an inner diameter and defining means for retaining a rotating assembly;

the rotating assembly rotatably mounted with respect to the race, the rotating assembly comprising a disc having a diameter and a radiused outer edge;

a bearing surface applied to the outer edge, the outer edge with the bearing surface applied thereto disposed within a groove; and a radiation attenuating member fastened to the disc and having at least first and second differently dimensioned radiation passing positions; and means for rotating the rotating assembly between first and second positions, whereby the radiation attenuating member is rotatable between a first and a second position.

14. The x-ray beam limiter of claim 13 wherein the bearing surface comprises polytetrafluoroethylene.

15. The x-ray beam limiter of claim 14 wherein the means for retaining the a groove in the inner surface.

16. The x-ray beam limiter of claim 13 wherein the means for rotating comprises:

a support plate;

an actuator pin fastened to the disc and disposed within an aperture in the support plate, the aperture and pin defining first and second rotatable positions of the disc;

an actuator disposed with a bore contained with the support plate and in communication with the actuator pin, which actuator causes the disc to assume the first rotatable position when the actuator is depressed; and a spring fastened to the disc and to the support plate which causes the disc to assume the second position when the actuator is not depressed.

17. A method of assembling an x-ray beam limiter, the method comprising:

applying a compressive force to a disc having a bearing surface applied to its outer edge;

inserting the disc into a groove disposed within the inner surface of a bearing retaining race;

removing the compressive force applied to the disc; and fastening an x-ray beam limiter having at least first and second radiation passing portions to the disc;

whereby the disc and the beam limiter are rotatably mounted within the bearing retaining race thereby allowing the passage of x-rays to be varied based on the position of the x-ray beam limiter.

18. The method of claim 17, further comprising the steps of:

fastening an actuator pin to the disc;

fastening a spring to the disc and to a support plate;

fastening the bearing retaining race to the support plate;

inserting an actuator in a bore within the support plate, which actuator is in communication with the actuator pin.

19. The method of claim 17 wherein the bearing surface comprises polytetrafluoroethylene.

20. The method of claim 17 wherein the disc comprises one of a fiberglass resin and a polyetherimide resin.

* * * * *